United States Patent [19]

Coleman et al.

[11] Patent Number: 4,978,151

[45] Date of Patent: Dec. 18, 1990

[54] LATCH-OPERATING MECHANISM FOR A PANIC EGRESS DEVICE

[75] Inventors: Michael D. Coleman, Zionsville; Kerry W. Stadtfeld, Greenwood, both of Ind.

[73] Assignee: Von Duprin, Inc., Indianapolis, Ind.

[21] Appl. No.: 394,886

[22] Filed: Aug. 17, 1989

[51] Int. Cl.[5] ..... E05B 65/10

[52] U.S. Cl. ..... 292/21; 292/92; 292/DIG. 62; 292/DIG. 65

[58] Field of Search ..... 70/92; 292/21, 92, 93, 292/DIG. 65, DIG. 62, 25, 26, 30, 33, 35, 36, 45, 48, 53, 336.3

[56] References Cited

U.S. PATENT DOCUMENTS

| | | | |
|---|---|---|---|
| 981,843 | 1/1911 | Davis | 292/41 X |
| 2,594,253 | 4/1952 | Vander Veer | 292/92 |
| 3,345,099 | 10/1967 | Paul et al. | 292/21 |
| 3,730,574 | 5/1973 | Zawadzki | 292/92 |
| 3,819,213 | 6/1974 | Vanderburgn | 292/21 |
| 4,601,499 | 7/1986 | Kim | 292/40 X |
| 4,741,563 | 5/1988 | Conrs | 292/21 |

*Primary Examiner*—Eric K. Nicholson
*Attorney, Agent, or Firm*—Walter C. Vliet

[57] ABSTRACT

The mechanism is configured to operate both a primary latch bolt and secondary latches, and provides for immediate, ready egress for the side of a door to which the mechanism is mounted, but offers high security for the other, outside of the door. The latch bolt is directly controlled by a first linkage, and the secondary latches are directly controlled by a second linkage. During egress, both linkages translate together, via a pin connection. However, a lost motion arrangement prevents retraction of either the bolt, or the secondary latches, if the other is compromised (or operated by a key or combination). From the outside, high security side of the door, the latch bolt and the secondary latches must be retracted together.

6 Claims, 2 Drawing Sheets

LATCH-OPERATING MECHANISM FOR A PANIC EGRESS DEVICE

This invention pertains to panic egress devices, and in particular to latch-operating mechanisms therefor.

Panic egress devices are used for (a) normal egress, and (b) conjunction with a high security latching. That is, from the outside of the door on which the panic egress device is mounted, the high security latching, and the panic egress latching must operate independently. If the high security latching is compromised, or operated by a key or combination, this should not release the panic egress latching; similarly, if the panic egress latching is compromised, or operated by a key or combination, this should be ineffective on the high security latching.

In prior art devices to which the invention pertains, a primary latch bolt, which may serve as a high security element shares a common linkage with secondary latches, i.e., concealed or externally-mounted vertical latches. Therefore, when the action rod of the mechanism is translated, all the latches are withdrawn. Too, then, if the primary latch bolt is retracted, from outside the door—by whatever means—the linkage causes the secondary latches to retract, and vice versa (if the secondary latches are caused to retract, from outside the door, the primary latch bolt will also retract).

Typical of such a prior art device, and incorporated herein by reference to explain the general functioning of such devices, is U.S. Pat. No. 4,741,563.

It is an object of this invention to set forth a latch-operating mechanism for a panic egress device, in which the normal egress via a door on which the device is mounted will retract all latches, i.e., a primary latch bolt, and secondary latches, but in which movement of either the primary latch bolt, or the secondary latches, will be ineffective on the other, if the same are moved from outside the door.

Particularly it is an object of this invention to set forth a latch-operating mechanism for a panic egress device, comprising a chassis; a housing coupled to said chassis; a primary latch bolt pivotably coupled to said housing; output shoes, for secondary latches, movably engaged with said chassis; and bellcranks pivotably mounted on said chassis; wherein first ends of said bellcranks are pivotably coupled to said shoes; and including first linkage means coupled to said primary latch bolt for effecting movement of said bolt relative to said housing; and second linkage means coupled to second ends of said bellcranks for effecting movement of said shoes relative to said chassis.

Further objects of this invention, as well as the novel features thereof, will become more apparent by reference to the following description, taken in conjunction with the accompanying figures, in which.

Figure 1:
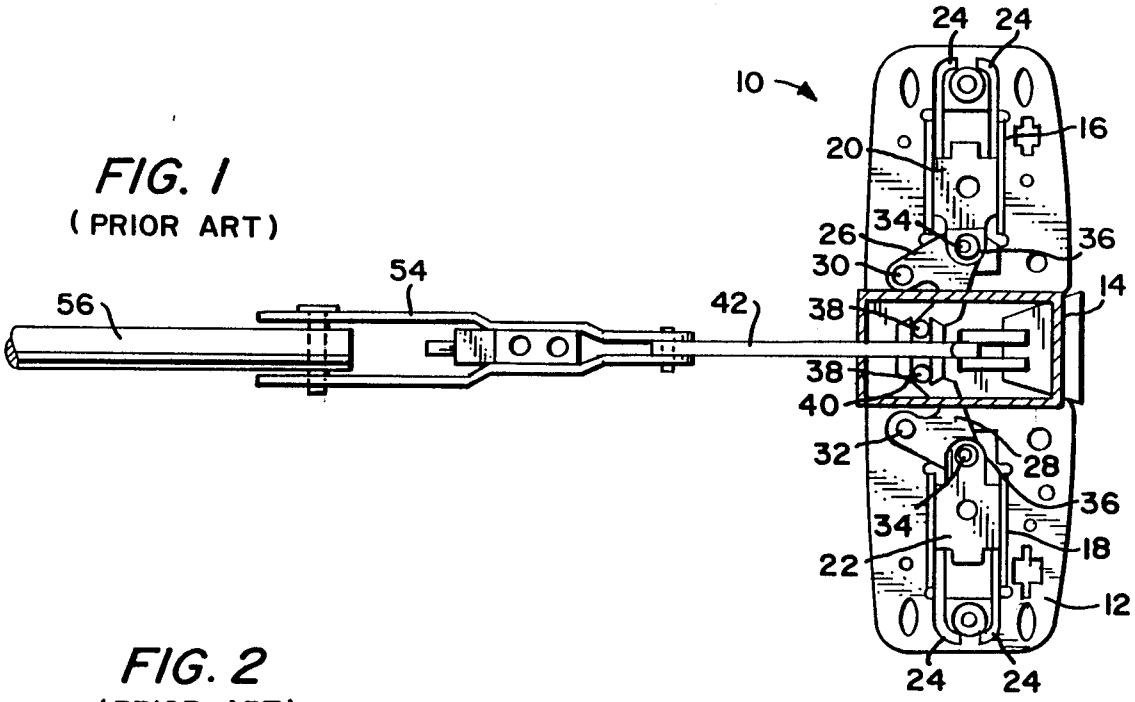
FIG. 1 (PRIOR ART)
FIG. 1 is a plan view of a prior art, latch-operating mechanism in which, however, the primary latch bolt and latch bolt link are not shown (for clarity of understanding), and the housing top is removed.
Figure 2:
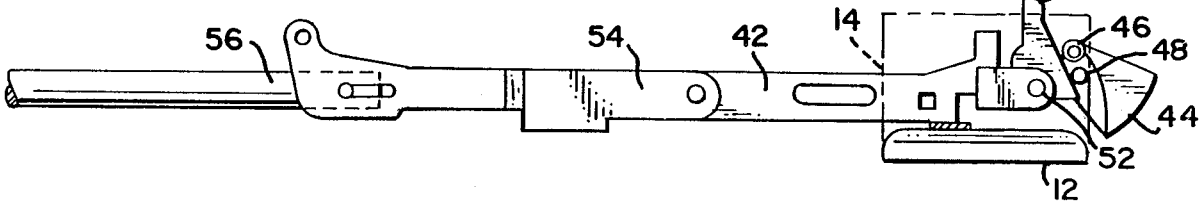
FIG. 2 (PRIOR ART)
FIG. 2 is a side elevational view of the mechanism of FIG. 1; this view shows the latch bolt and its link, but the housing is shown only in phantom.
Figure 3:
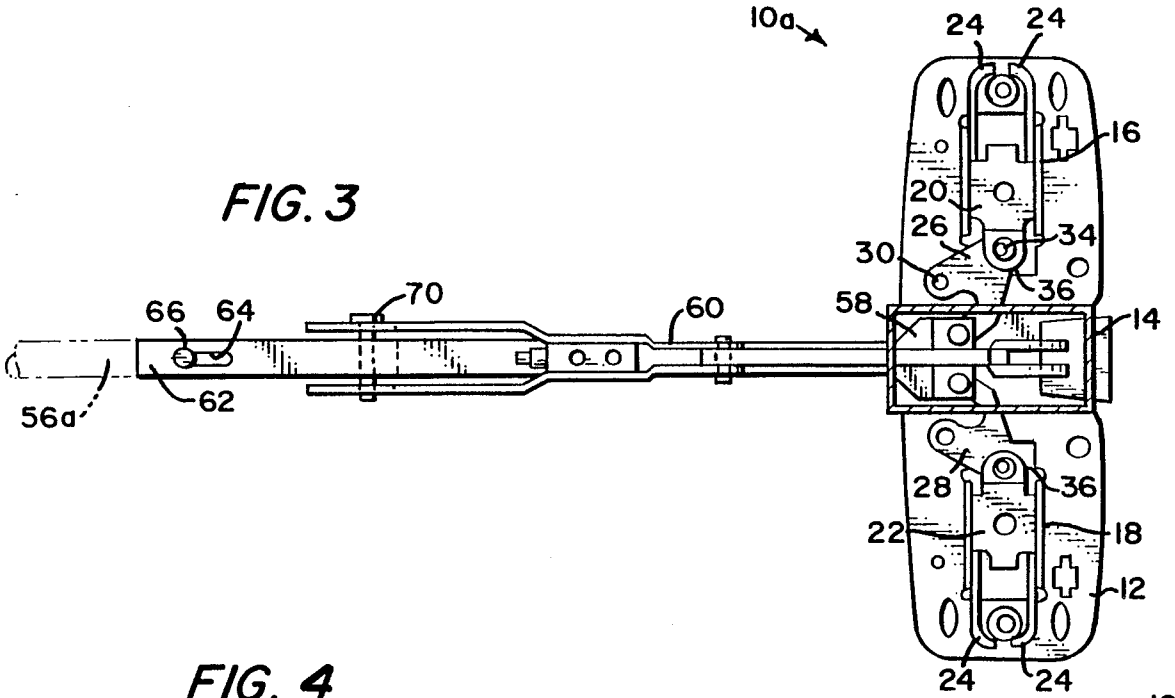
Figure 4:
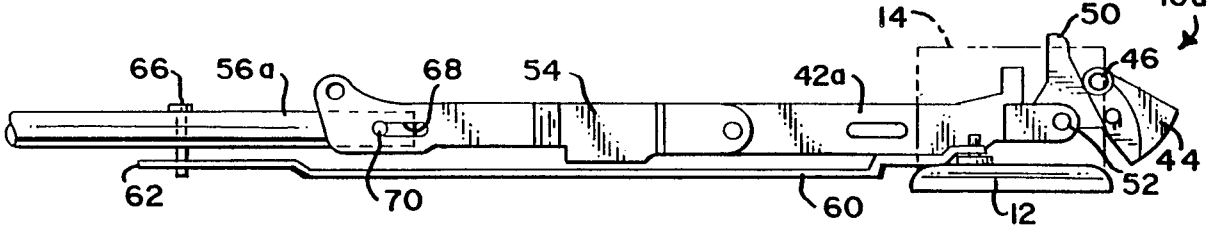

FIGS. 3 and 4 correspond to FIGS. 1 and 2, respectively, but depict the novel latch-operating mechanism according to an embodiment thereof.

As shown in FIGS. 1 and 2, a prior art latch-operating mechanism 10 comprises a chassis 12 to which is mounted a housing 14. The chassis 12 has a pair of guide ways 16 and 18 which slidably receive a pair of secondary latch output shoes 20 and 22. The shoes 20 and 22 have projecting fingers 24 which, as detailed in the aforesaid referenced and incorporated U.S. patent, are used to operate secondary, vertical latches (not shown). Bellcranks 26 and 28 are pivotably mounted onto the chassis 12, at pivot points 30 and 32, respectively. First ends 34 of the bellcranks are pivotably coupled to innermost ends 36 of the shoes 20 and 22, and the other ends 38 of the bellcranks are captured in a keeper 40. The keeper 40 is an underslung element which is integral with a control link 42.

A primary latch bolt 44 is pivotably mounted to the housing 14, by means of a pivot pin 46; too another pin 48 couples the bolt 44 to a link 50. The latter is pinned, via a pin 52, to a bifurcation end of the control link 42. The control link 42 is coupled to a control linkage 54, and the latter is coupled to an action rod 56. The rod 56, as explained in the aforesaid patent, is translated by a push pad (not shown). With translation of the rod 56, then, to the left (as shown in FIGS. 1 and 2), coincidentally the bolt 44 and the shoes 20 and 22 will be moved; the bolt 44 will retract, and the shoes 20 and 22 will close toward the housing 14. Biasing means (not shown) within the housing 14 urge the bolt to return to the extended disposition (as depicted in FIG. 2).

Due to the coupling of the shoes 20 and 22 and the bolt 44 in common with the control link 42, externally effected (i.e., from the outside of the door to which the mechanism 10 is mounted) movement of bolt into retraction will also cause the shoes 20 and 22 to retract the vertical latches. Similarly, if the vertical latches are caused to retract, the bolt 44 will also retract. Consequently, this prior art mechanism will not offer a high security latching.

The novel mechanism 10*a*, shown in FIGS. 3 and 4, does offer a high security latching, and yet it provides for ready egress.

Same or similar elements and components shown in FIGS. 3 and 4, carry some or similar index numbers as their complements in FIGS. 1 and 2. In FIG. 4 (as well as in FIG. 2) bellcranks 26 and 28, and the shoes 20 and 22 are not shown (for clarity of understanding).

In mechanism 10*a*, the control link 42*a* ends in a same bifurcation in which the link 50 is pinned, via pin 52, but it is devoid of a keeper (such as keeper 40 in FIG. 1). Link 42*a* is directly coupled only to the primary latch bolt 44. The ends 38 of the bellcranks 26 and 28, in this embodiment of the invention, are coupled to a web 58 which terminates a linkage member 60. Web 58 underlies the link 42*a*, and is slidably disposed on the chassis 12. The remote end 62 of member 60 has a slot 64 formed therein. A pin 66, fixed in the action rod 26*a*, projects therefrom and intrudes into the slot 64. By this means, the linkage member 60 is coupled to the action rod 56*a* for coincident movement with the action rod 56*a*, when the mechanism is operated, from inside the door (to which it is mounted), for egress. Translation of the action rod 56*a* will retract the bolt 44 and the vertical latches (not shown) which are controlled by the shoes 20 and 22. However, the mechanism 10*a* provides for high security, from outside the door, in that a retraction of the bolt 44—by whatever means—will not retract the vertical latches. The control link 42*a*, and control linkage 54, will move to the left (as viewed in FIGS. 3 and 4), but the control linkage 54 also has a slot 68 formed therein on both sides thereof. The slot 68 receives a pin 70, which is fixed in the action rod 56*a*, and simply slides along the pin. Consequently, translation of the control linkage 54 will not translate the action rod 56*a*. As the rod 56*a* does not translate, the linkage member 60 also does not move; the bellcranks, therefore, are not moved, and the security provided by the secondary latches remains.

A same result follows if the secondary latches are retracted, from outside the door. The shoes 20 and 22 will move toward the housing 14, and the linkage member 60 will translate to the left (per FIGS. 3 and 4), but the slot 64 will simply slide along the pin 66, and the action rod 56*a* will remain immobile; consequently, the bolt 44 will remain latched.

Mechanism 10*a*, therefore, requires that the vertical latches and the latch bolt 44 to be retracted together before entry can be gotten from outside the door. Even so, translation of the action rod 56*a*, from inside the door, gives full egress. The disposition of the pin 66 in the outermost end of the slot 64 causes the linkage member 60, which controls the vertical latches, to translate with the action rod 56*a*; the latter, of course, controls the latch bolt 44.

Priorly, when both high security and panic egress were required, it was necessary to provide two doors for the high security room or area. One door had the panic egress mechanism mounted on the inside, with no means of entry from the outside. The other door had a high security lock as a means of passage from outside of the door. The instant invention provides for both ready egress and high security. Access from outside must overcome two latching systems, but translation of the action rod 56*a*, by a push pad from inside the door, give immediate egress. While it is not a part of this invention, the high security passage can be accomplished by the employment of a key arrangement for the latch bolt, and a combination arrangement for the vertical latches, or vice versa.

While I have described my invention in connection with a specific embodiment thereof it is to be clearly understood that this is done only by way of example, and not as a limitation to the scope of my invention, as set forth in the objects thereof and in the appended claims.

I claim:

1. A latch-operating mechanism for a panic egress device, comprising: a chassis; a housing coupled to said chassis; a primary latch bolt pivotably coupled to said housing; output shoes for secondary latches, said output shoes being movably engaged with said chassis; and bellcranks pivotably mounted on said chassis; wherein first ends of each of said bellcranks are pivotably coupled to said shoes; and including first linkage means coupled to said primary latch bolt for effecting movement of said bolt relative to said housing; second linkage means coupled to second ends of said bellcranks for effecting movement of said shoes relative to said chassis; said first and second linkage means are slidably engaged with said housing and said chassis, respectively; and including means coupling said linkage means together (a) for coincident movement of both said linkage means, in a first mode of operation of said mechanism, and (b) for independent movement of one of said linkage means with respect to the other of said linkage means, in a second mode of operation of said mechanism.

2. A latch-operating mechanism, according to claim 1, wherein: said coupling means comprises a pin fixed in one of said linkage means, and engaged with the other of said linkage means.

3. A latch-operating mechanism, according to claim 1, wherein: said coupling means comprises a pin fixed in said first linkage means, and engaged with said second linkage means.

4. A latch-operating mechanism, according to claim 3, wherein: said first linkage means comprises an elongate limb; said pin is fixed in said limb and has a portion thereof projecting perpendicularly from said limb; said second linkage means comprises an elongate member; said member has a slot formed therein; and said portion protrudes into said slot.

5. A latch-operating mechanism for a panic egress device, comprising: a chassis; a housing coupled to said chassis; a primary latch bolt pivotably coupled to said housing; output shoes for secondary latches movably engaged with said chassis; and bellcranks pivotably mounted on said chassis; wherein a first end of each of said bellcranks is pivotably coupled to one of said shoes; and including means coupled to said primary latch bolt, and slidably engaged with said housing, (a) for effecting movement of said bolt relative to said housing, and (b) slidably movable, relative to said housing, in response to movement of said bolt; linkage coupled to second ends of said bellcranks, and slidably engaged with said chassis, (a) for effecting movement of said shoes relative to said chassis, and (b) slidably movable, relative to said chassis, in response to movement of said shoes; and a pin coupling said means and linkage together (a) for coincident movement of said means and linkage, in a first mode of operation of said mechanism, and (b) for independent movement of said linkage with respect to said means in a second mode of operation of said mechanism.

6. A latch-operating mechanism, according to claim 5, wherein: said means comprises an elongate limb; said pin is fixed in said limb and has a portion thereof projecting perpendicularly from said limb; said linkage has a slot formed therein; and said portion protrudes into said slot.

* * * * *